United States Patent [19]

Hanthorn

[11] Patent Number: 4,875,547

[45] Date of Patent: Oct. 24, 1989

[54] PORTABLE CONVEYOR SYSTEM WITH TELESCOPIC BOOM ASSEMBLY AND LOAD CARRYING APPARATUS

[76] Inventor: Philip T. Hanthorn, 1409 Carl Ave., Vallejo, Calif. 94590

[21] Appl. No.: 278,809

[22] Filed: Dec. 2, 1988

Related U.S. Application Data

[63] Continuation-in-part of Ser. No. 75,410, Jul. 20, 1987, Pat. No. 4,793,437.

[51] Int. Cl.[4] ..... E06C 5/04; B66B 9/20

[52] U.S. Cl. ..... 182/102; 182/82; 182/145; 182/206; 187/10

[58] Field of Search ..... 182/102, 103, 101, 63, 182/40, 142, 145, 82, 206; 187/10

[56] References Cited

U.S: PATENT DOCUMENTS

| | | | |
|---|---|---|---|
| 582,753 | 5/1897 | Lyst | 182/40 |
| 2,312,833 | 3/1943 | Graham | 182/102 |
| 3,666,054 | 5/1972 | Ellings | 187/10 |
| 3,693,755 | 9/1972 | Terayama | 182/145 |
| 3,891,062 | 6/1975 | Geneste | 187/10 |
| 4,183,423 | 1/1980 | Lewis | 187/10 |
| 4,491,196 | 1/1985 | Bocker | 187/10 |
| 4,546,854 | 10/1985 | Bocker | 187/10 |
| 4,706,779 | 11/1987 | Bono | 182/145 |
| 4,793,437 | 12/1988 | Hanthorn | 182/2 |

*Primary Examiner*—Reinaldo P. Machado

*Attorney, Agent, or Firm*—Phillips, Moore, Lempio & Finley

[57] ABSTRACT

A portable conveyor system comprises an extensible and retractable boom assembly mounted on a transportable stationary support. The boom assembly comprises a plurality of longitudinally spaced rungs defining a series of supporting surfaces for a primary load carrier of the type described in applicant's co-pending U.S. patent application Ser. No. 75,410, now U.S. Pat. No. 4,793,437. The improvements described herein include a vertically adjustable hitch mounted forwardly on a frame of the primary load carrier. The hitch is adapted for attachment to the end of the cable of a winch assembly to move the endless tracks of the carrier in full contact along the supporting surfaces of the rungs. Other improvements include modified boom and overhead bracket assemblies, a resilient suspension system for the primary load carrier and a platform assembly attachable to either end of the boom assembly to alternately function as a loading or unloading platform.

19 Claims, 10 Drawing Sheets

FIGURE 10
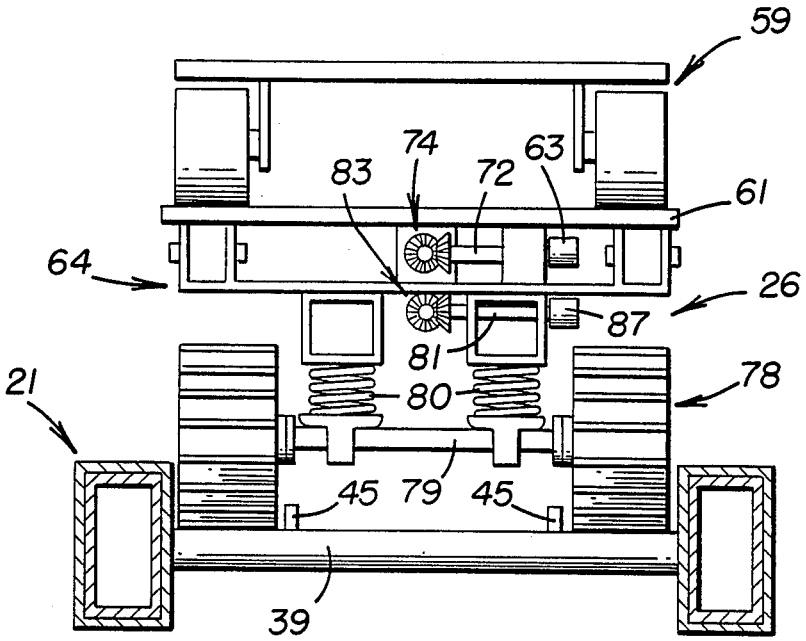
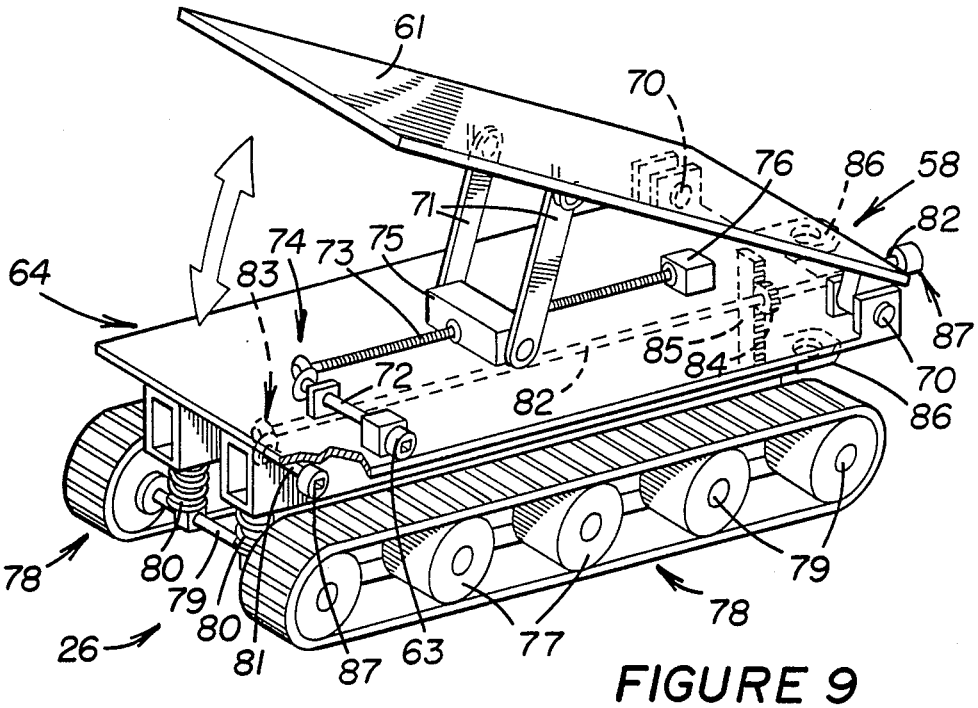
FIGURE 9

PORTABLE CONVEYOR SYSTEM WITH TELESCOPIC BOOM ASSEMBLY AND LOAD CARRYING APPARATUS

CROSS-REFERENCE TO RELATED APPLICATION

This application is a continuation-in-part of U.S. patent application Ser. No. 75,410, filed by applicant on July 20, 1987 for "PORTABLE LIFT WITH TELESCOPIC BOOMS AND LOAD-CARRYING APPARATUS" and now U.S. Pat. No. 4,793,437.

TECHNICAL FIELD

This invention relates generally to a portable conveyor system and more particularly to a conveyor system having an inclined telescopic boom assembly for supporting the movement of a load-carrying apparatus thereon.

BACKGROUND OF THE INVENTION

Applicant's above-referenced application, incorporated by reference herein, describes many types of conventional lift and conveyor systems adapted to elevate heavy loads, such as a refrigerator, to an upper story of a building. In addition to being complex in construction, such conventional lift and conveyor systems are oftentimes difficult to assemble and use and do not always provide the structural integrity required.

SUMMARY OF THE INVENTION

An object of this invention is to provide an improved conveyor system comprising a pair of extensible and retractable telescopic booms positioned in side-by-side relationship, stationary support means having lower ends of the booms mounted thereon to extend the boom assembly upwardly and forwardly from the support means, a plurality of longitudinally spaced rungs interconnected between the booms to define a series of supporting surfaces, and a mobile primary load carrier mounted for movement on the supporting surfaces of the rungs. The load carrier includes a frame, a load carrying primary platform, and adjustment means for selectively moving the primary platform to an acute angle relative to the frame.

In one aspect of this invention, a hitch is mounted forwardly on the frame for attachment to the cable of a winch and adjustment means are provided for selectively moving the hitch vertically relative to the frame to control the disposition of the primary load carrier on the supporting surfaces of the rungs.

In other aspects of this invention, the boom assembly, the primary load carrier and an overhead bracket assembly have been modified, with the load carrier now including a resilient suspension system between its frame and endless track assemblies. In addition, a platform assembly has been added for attachment to either end of the boom assembly to alternately function as a loading or unloading platform.

BRIEF DESCRIPTION OF THE DRAWINGS

Other objects and advantages of this invention will become apparent from the following description and accompanying drawings wherein:

FIG. 9 is an isometric view illustrating the primary load carrier;

FIG. 10 is a rear elevational view of the primary load carrier, as it would appear mounted for movement on the boom assembly;

DESCRIPTION OF THE PREFERRED EMBODIMENT

Figure 1:
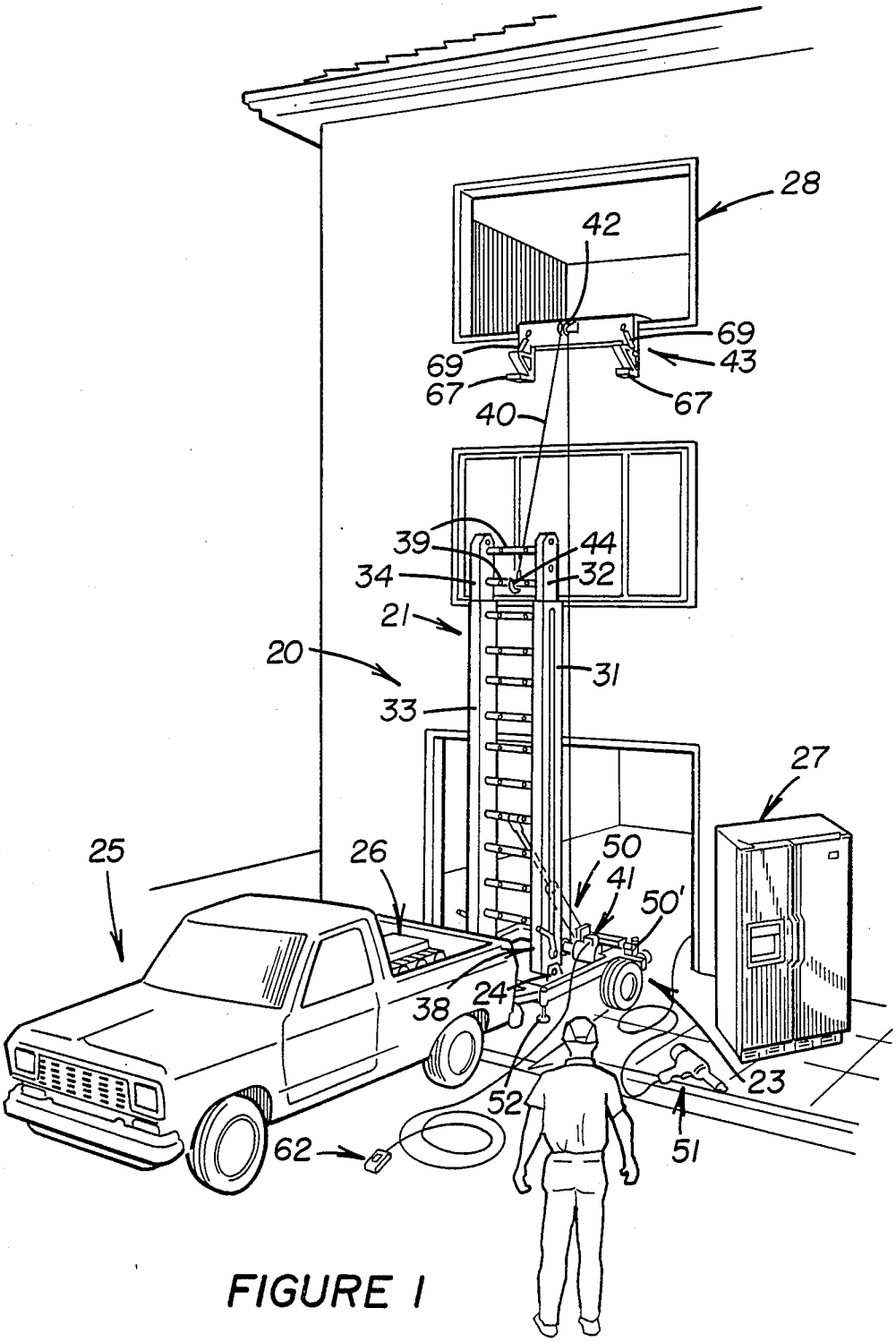
FIG. 1 illustrates the depositing of a portable conveyor of this invention adjacent to a building for moving a refrigerator from ground level to a third story apartment of the building.

FIG. 1 illustrates a conveyor system 20 comprising a ladder-like boom assembly 21 having its lower end pivotally mounted on a frame 22 of a transport trailer 23 by pins 24. The trailer is adapted for attachment to the standard hitch of a pick-up truck 25 for transporting and depositing the conveyor system, including a primary load carrier 26, adjacent to a building. In the illustrated application, the conveyor system is used to lift and deposit a heavy object, such as an illustrated refrigerator 27, through a third story window frame 28 having its window removed.

Figure 2:
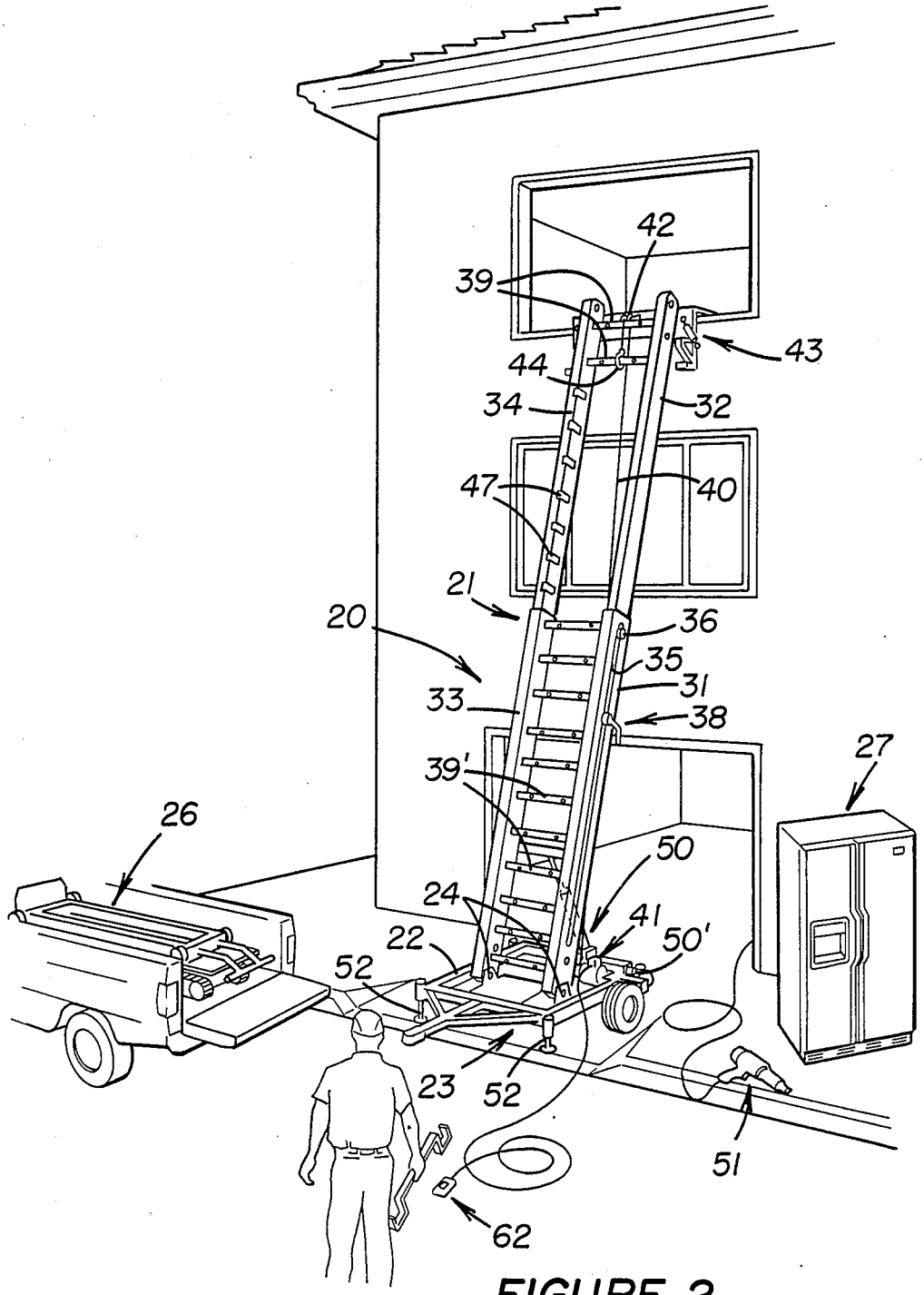
FIGS. 2–7 are views similar to FIG. 1 and sequentially illustrate assembly and use of the conveyor system for lifting a refrigerator to the third-story apartment of the building.

As sequentially illustrated in FIGS. 1 and 2, boom assembly 21 comprises a pair of extensible and retractable telescopic booms 29 and 30 positioned in side-by-side relationship relative to each other. Boom 29 comprises a pair of boom sections including an outer channel 31 having an inner channel 32 slidably mounted therein whereas boom 30 comprises similar boom sections including outer and inner channels 33 and 34, respectively. The outer side of channel 31 has a longitudinally extending slot 35 formed therein adapted to slidably receive the distal head end of a pin 36. The shank end of the pin is secured to boom 32.

A standard releasable camlock assembly 38 can be utilized to secure the boom assembly in its extended position in a conventional manner. Applicant's above-referenced U.S. patent application No. 75,410 discloses an alternative locking arrangement for holding the channels of the booms at a selected extended and locked position. It should be understood that slot 35 and pin 36 could also be used on boom 30, along with camlock assembly 38.

A pair of fixed rungs 39 are secured between the upper ends of channels 32 and 34 whereas a plurality of longitudinally spaced and horizontally disposed fixed rungs 39' are secured between outer channels 31 and 33. When it is desired to extend the boom assembly from its FIG. to its FIG. 2 position, a cable 40, having its proximal end wound on the drum of a winch assembly 41, is payed-out and entrained over a pulley 42. The pulley is rotatably mounted forwardly on an overhead bracket assembly 43 attached to the sill of window frame 28.

A hook 44, attached to the distal end of the cable, engages under one of the fixed rungs 39 for this purpose. The variable electric drive motor of the winch assembly can be selectively actuated (by a hand-held control 62) to extend the boom assembly for attachment to overhead bracket assembly 43, described more fully hereinafter. Briefly referring to FIG. 10, a pair of laterally spaced pins 45 can be secured on each rung 39 and 39' (as well as removable rungs 46) to provide guide means on the inner sides of the endless tracks of load carrier 2 to prevent lateral shifting and to properly guide the linear travel of the carrier for its subsequent alignment with the receiving platform.

Figures 3, 3A:
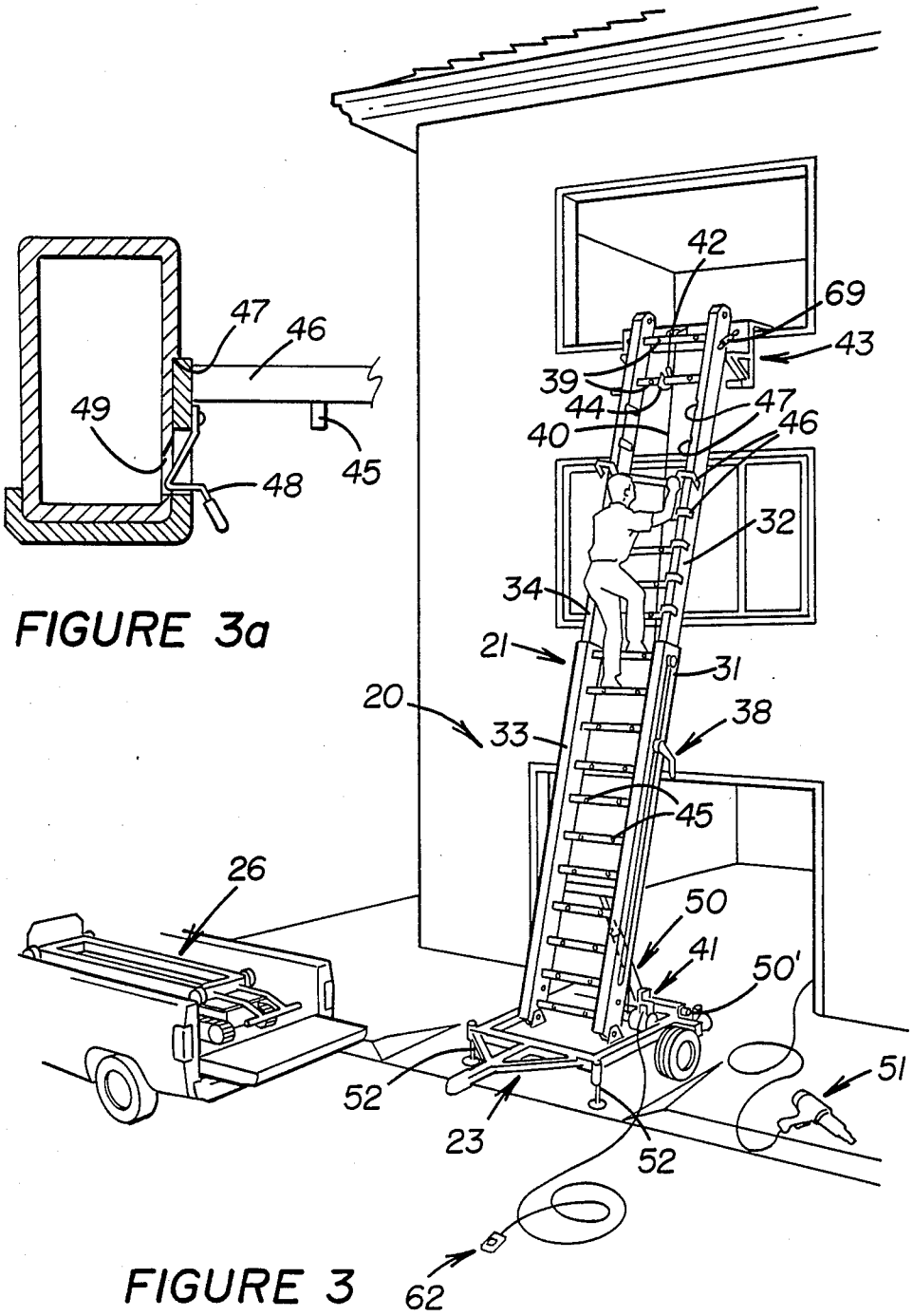
FIG. 3*a* is an enlarged cross-sectional view, illustrating releasable attachment of one end of a removable rung to a telescopic boom used in a boom assembly of the conveyor system.
Figure 7:
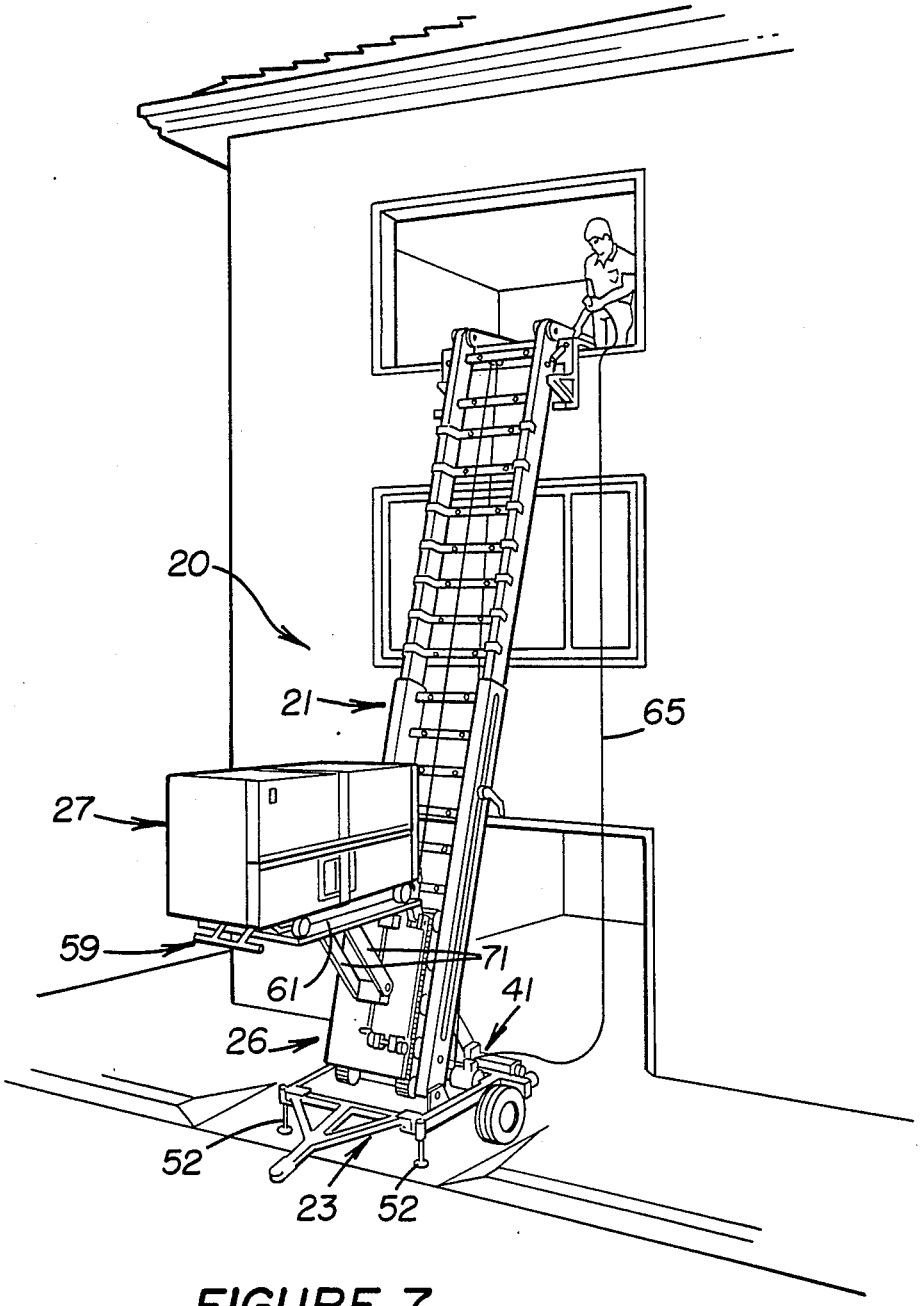

Referring to FIGS. 3 and 3*a*, the workman will then insert a plurality of removable rungs 46 within opposing slots 47, defined on the inner sides of inner channels 31, in substantially the same manner described in applicant's above-referenced application. A resilient (steel) springlatch 48 is preferably secured on at least one end of each rungs 46 to engage within a slot 49, formed through an inner side of a respective inner channel 32 or 34, to aid in locking the rung in place. As described in applicant's above-referenced application, fixed rungs 39 and 39' and removable rungs 46 collectively define a series of vertically spaced an horizontally disposed supporting surfaces thereon adapted to guide movements of the tracks of primary load carrier 26, along boom assembly 21 (FIG. 7).

As further described in applicant's above-referenced application, an adjustable link or strut 50 is pivotally interconnected between a back side of boom assembly 21 and frame 22 of trailer 23 to selectively adjust the degree of tilt of the boom assembly relatively to ground level. As described, extensible and retractable ink 50 is threadably adjustable to be selectively extended or retracted in a convention manner, either manually or by use of a standard electric impact wrench 51 engageable with a rotary drive socket 50'. The drive socket is connected to link 50 by a standard drive train, including suitably arranged shafts and gearing, e.g., generally of the type shown in FIGS. 9–13 to translate rotary motion of socket 50' to rotary motion of one part of link 50.

A standard leveling jack 52 is mounted at each corner of frame 22 of trailer 23 to level the frame to correctly position boom assembly 21. Impact wrench 51 can also be used for this purpose, as will be appreciated by those skilled in the art. The tires of the trailer can be lifted slightly above ground-level to provide a fully stabilized and stationary support for the boom assembly.

Figure 4:
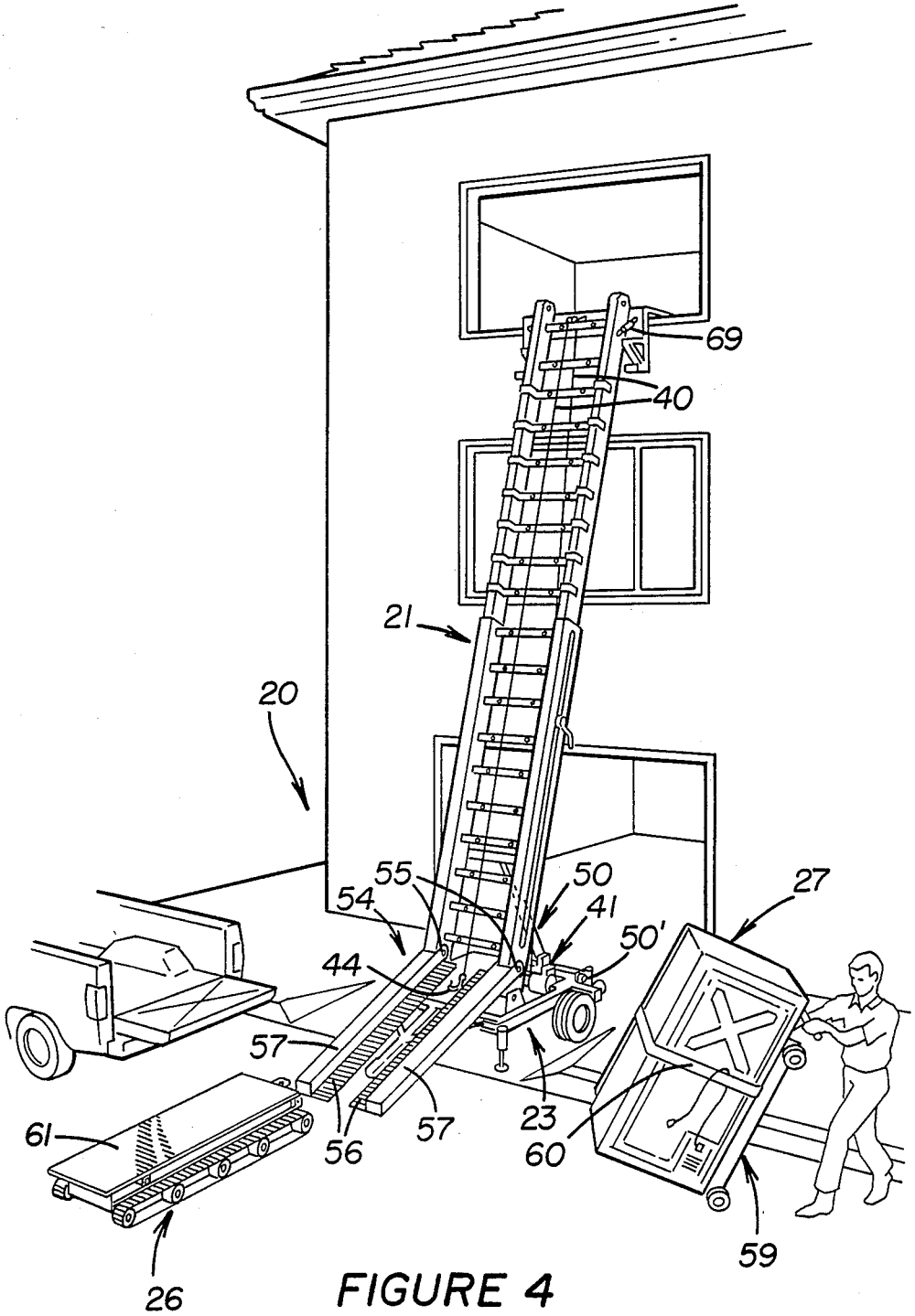

Referring to FIG. 4, the frontal end of a dual-purpose loading and unloading platform 54 is connected to the lower ends of outer channels 31 and 33 of boom assembly 21 by removable pins 55. The platform has a pair of parallel receiving rails 56 suitably sized to receive the tracks of primary load carrier 26, described more fully hereinafter. A pair of outer rails 57 guide the tracks of the load carrier when hook 44 of cable 40 is attached to an adjustable hitch assembly 58 mounted forwardly on the load carrier.

Figure 5:
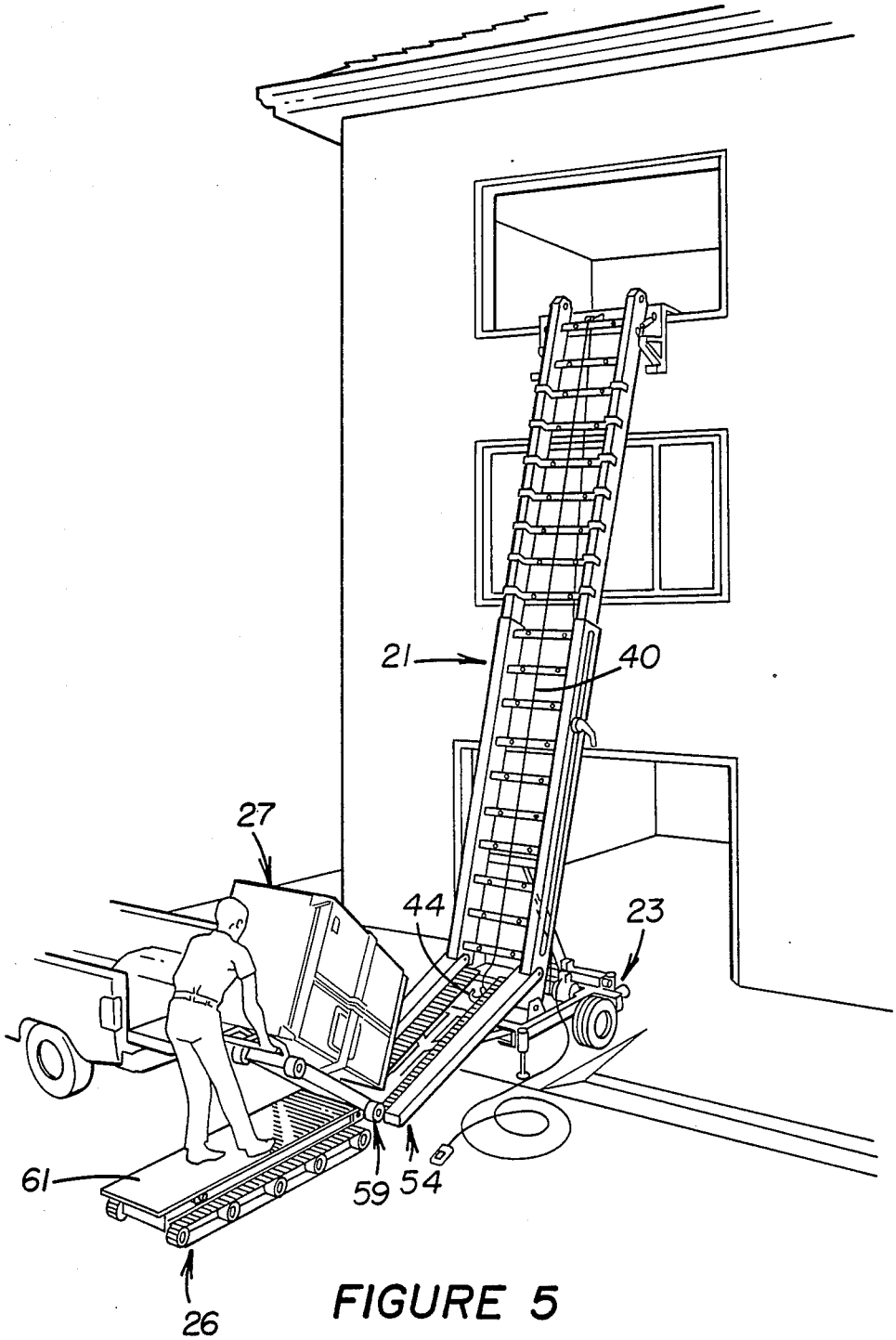
Figure 6:
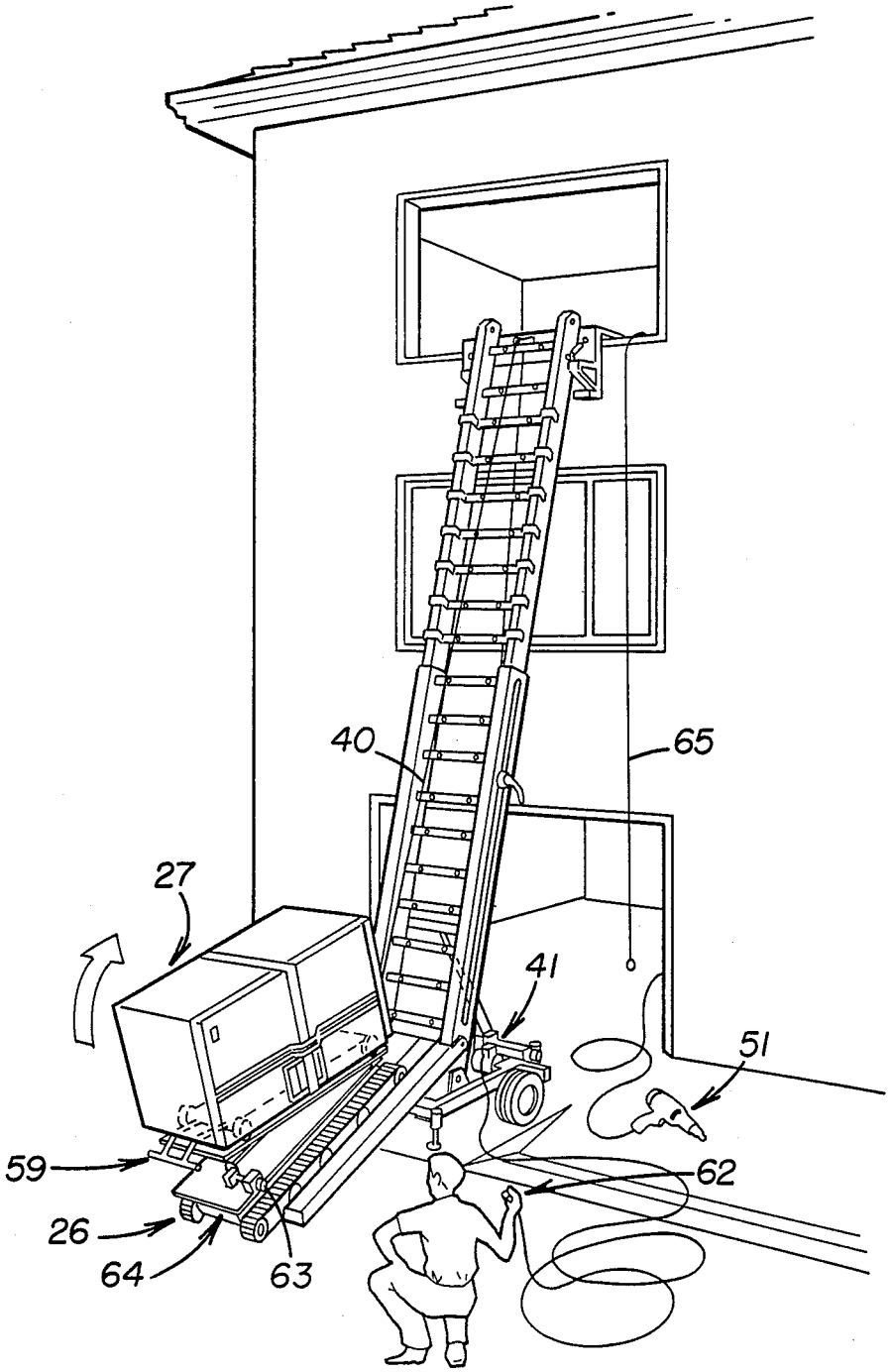

As sequentially shown in FIGS. 4–6, refrigerator 27 is secured on a secondary load carrier 59 by at least one strap 60. The secondary load carrier is in a form of a dolley adapted to be placed on a primary platform 61 of primary load carrier 26, as shown in FIG. 5. As shown in FIG. 6, hook 44 of cable 40 is attached to the hitch assembly of primary load carrier 26 to enable a workman to manipulate a hand-held control 62 to actuate the motor of winch assembly 41 to move the primary load carrier along parallel rails 56 of loading platform 54 for ascent on boom assembly 21.

As described more fully hereinafter with reference to FIG. 9 the male head of impact wrench 51 is adapted to engage a socket 63 of an adjustment means for selectively moving primary platform 61 to an acute angle relative to a frame 64 of the primary load carrier. The workman is thus enabled to adjust the platform t position it horizontally (parallel to ground level) during ascent of the primary load carrier on the boom assembly (FIG. 7).

Referring to FIGS. 6 and 7, after the workman has properly placed the primary load carrier on the rungs of boom assembly 21, hand control 62 is attached to a cord 65 so that the control can be pulled through window frame 28 and manipulated at that location. Loading platform 54 is disconnected from the boom assembly by removing pins 55 and is then carried upstairs to the apartment whereat the primary load carrier and refrigerator are received, through the window frame. As described more fully hereinafter, a socket 66 is adapted to be engaged by the head of impact wrench 51 to periodically adjust hitch assembly 5 vertically (FIGS. 9–13) to insure that the tracks of the primary load carrier will fully engage the rungs of the boom assembly. This feature of the invention functions to evenly distribute the weight of the primary lad carrier and its load over the supporting surfaces of the rungs.

Figure 8:
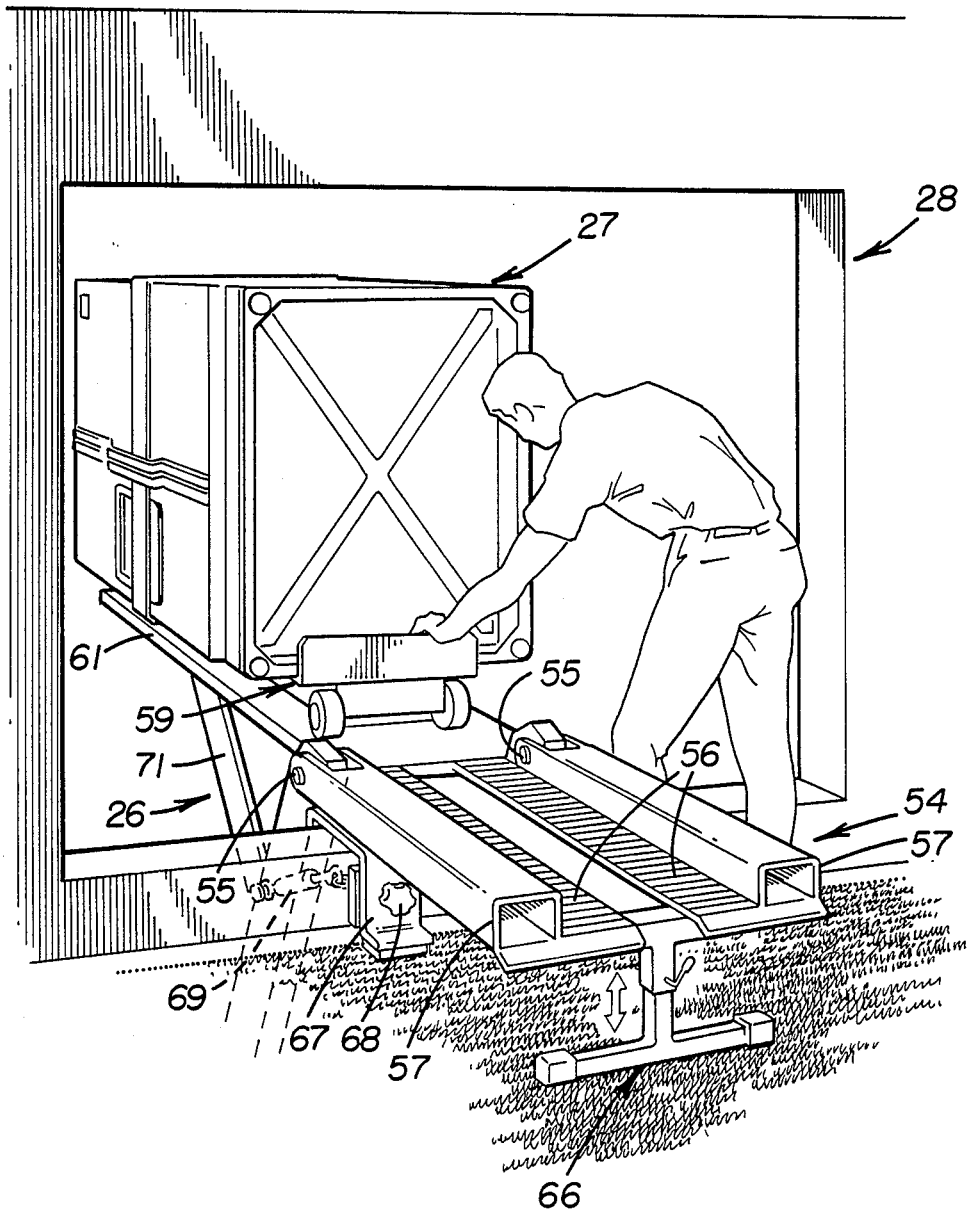
FIG. 8 is a view looking outwardly from the apartment with a workman shown receiving the refrigerator and a supporting primary load carrier from the boom assembly.
Figure 11:
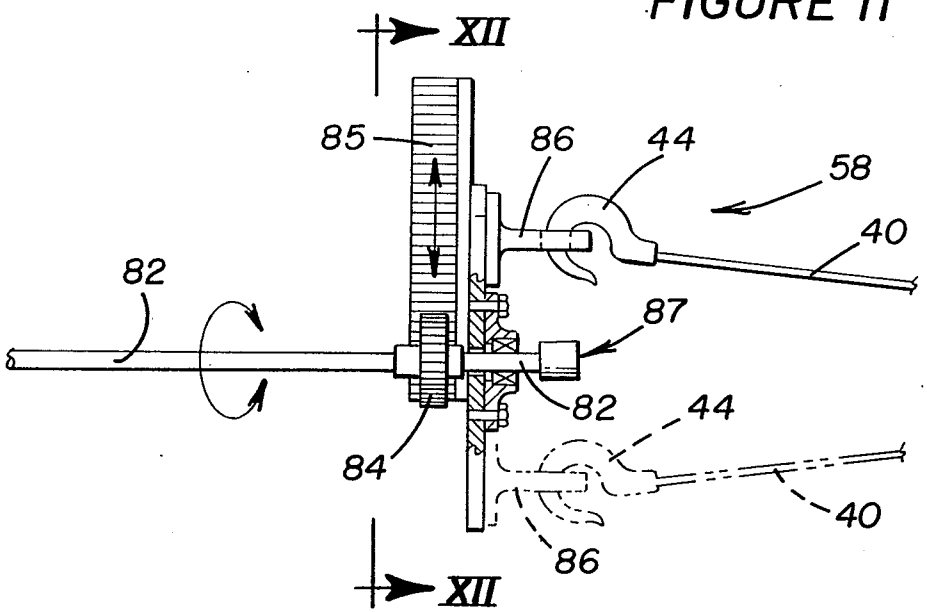
FIG. 11 is a side elevational view of an adjustable hitch mounted forwardly on a frame of the primary load carrier.
Figure 12:
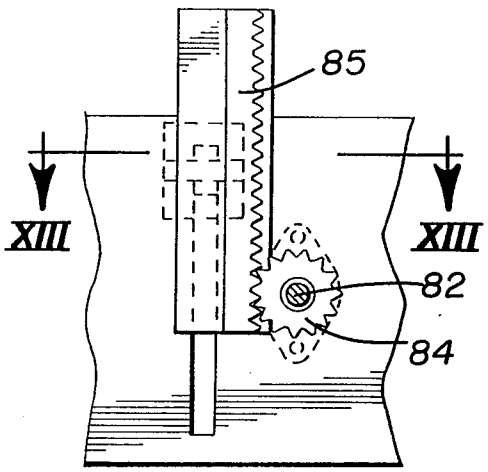
FIG. 12 is an elevational view of the adjustable hitch and its associated adjustment mechanisms, taken in a direction of arrows XII—XII in FIG. 11.
Figure 13:
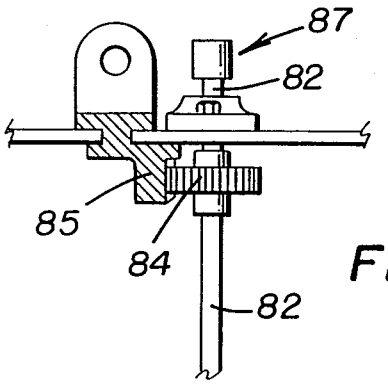
FIG. 13 is a sectional view, taken in a direction of arrows XIII—XIII in FIG. 12.

Referring to FIGS. 7 and 8, the workman is now enabled to manipulate control 62 in the apartment. In particular, selective manipulation of the control will wind cable 40 on the drum of winch assembly 41 to raise the primary load carrier to the top of boom assembly 21 As shown in FIG. 8, platform 54 is attached by pins 55 to the upper ends of inner channels 32 and 34 of the boom assembly to now function as an unloading platform. The free end to the platform has an adjustable pedestal 66 for vertically adjusting the level of rails 56 and to provide level engagement of the platform on overhead bracket assembly 43.

When the workman receives the primary load carrier and refrigerator 27, primary load platform 61 is horizontally disposed relative to rails 56 whereby secondary load carrier 59 and refrigerator 27 can be easily removed from the conveyor system and wheeled directly to a desired location in the apartment. Bracket assembly 43 comprises a pair of laterally spaced C-shaped clamping brackets 67 (FIGS. 1 and 8) mounted over the sill of window frame 28 and a thumb screw 68 threadably mounted on the backside of each bracket to clamp the bracket in place. A longitudinally adjustable link 69 can be releasably attached by bolts or pins between the outer side of bracket assembly 43 and inner channels 32 and 34 of the boom assembly to further secure the upper end of the boom assembly in place.

The conveyor system is lowered and disassembled for transport purposes in a reverse manner from the assembly procedure described above. Further, the conveyor system can obviously be used to lower heavy objects to street level by reversing the lifting process.

FIGS. 9 and 10 illustrate modifications to the load carrier disclosed in applicant's above-referenced application. The adjustment means for selectively pivoting primary platform 61 on pins 70 of load carrier 26 to an acute angle relative to frame 64, via links 71, includes socket 63 which is attached to a rotatable shaft 72. Rotation of shaft 72 will, in turn, rotate a threaded shaft 73 via a pair of intermeshing bevel gears 74. Shaft 73 is threaded to a moveable block 75 having its distal end rotatably mounted in a stationary block 76, secured on frame 64, by a standard ball and socket connection. Thus, rotation of threaded shaft 73 will function to pivot platform up or down relative to the frame, depending on direction of rotation of socket 63 by impact wrench 51. Links 71 are pivotally interconnected between platform 61 and block 75 and the forward end of the platform is pivotally mounted on the forward end of frame 64 by pins 70 to facilitate such adjustment.

Laterally spaced pairs of rollers 77 of a pair of laterally spaced endless track assembles 78 are secured on axles 79. A pair of laterally spaced suspension springs 80 are mounted between frame 64 and each axle. The springs thus provide a resilient suspension for frame 64 and attached platform 61, on the undercarriage of the primary load carrier.

FIGS. 9–13 illustrate an adjustment means for hitch assembly 58 comprising socket 66, secured to the end of a rotatable shaft 81 (FIG. 9) to drive a shaft 82 via intermeshing bevel gears 83. The distal end of shaft 82 is secured to a pinion gear 84 that meshes with the teeth of a vertically disposed rack 85, reciprocally mounted on frame 64 in a conventional manner. As more clearly shown in FIGS. 11–13, rack 85 is secured to a hitch 86 of the hitch assembly whereby rotation of shaft 81, by engagement of impact wrench 51 with socket 66, will reciprocate hitch 86 to a selected vertical position. This adjustment insures that the tracks of the primary load carrier will fully engage the supporting surfaces defined on rungs 39, 39' and 46 (FIG. 4) when the load carrier is moved therealong. A second socket 66 is preferably secured to the distal end of shaft 82, at the front end of primary load carrier 26, to facilitate adjustment of hitch 86 thereat.

I claim:

1. A portable conveyor system comprising a boom assembly comprising a pair of extensible and retractable telescopic booms positioned in side-by-side relationship and a plurality of longitudinally spaced rungs interconnected between said booms to define a series of vertically spaced and horizontally disposed supporting surfaces, support means having lower ends of said booms mounted thereon to extend said boom assembly upwardly and forwardly from said support means, and a mobile primary load carrier means mounted for movement on the supporting surfaces of said rungs, said primary load carrier means including a frame, a load-carrying primary platform pivotally mounted on said frame, first adjustment means for selectively pivoting said primary platform to an acute angle relative to said frame, a hitch mounted forwardly on said frame for attachment to a cable of a winch, and second adjustment means for selectively moving said hitch vertically relative to said frame to control the disposition of said load carrier on the supporting surfaces of said rungs.

2. The portable conveyor system of claim 1 wherein each of said booms comprises a pair of telescopic inner and outer boom sections and wherein said rungs include a plurality of first rungs fixedly secured between upper ends of said inner boom sections and a plurality of second rungs secured between said outer boom sections.

3. The portable conveyor system of claim 2 wherein said rungs further include a plurality of third rungs releasably connected between said inner boom sections, said third rungs positioned longitudinally between said first and second rungs.

4. The portable conveyor system of claim 3 further comprising means for releasably locking each of said third rungs to at least one of said inner sections.

5. The portable conveyor system of claim 1 wherein said support means comprises a mobile trailer having lower ends of said boom pivotally mounted thereon and means on said trailer for leveling said trailer relative to ground level and for stabilizing said trailer and boom assembly.

6. The portable conveyor system of claim 5 further comprising tilt adjustment means mounted on said trailer for selectively pivoting said boom assembly on said trailer to selectively vary the inclination of said boom assembly relative to ground level.

7. the portable conveyor system of claim 1 further comprising winch means, including a cable alternately attachable to said boom assembly or to said primary load carrier means, for selectively extending or retracting said boom assembly or for selectively raising or lowering said primary load carrier means on the supporting surfaces of said rungs, respectively.

8. The portable conveyor system of claim 1 further comprising a dual-purpose loading and unloading platform and means for alternately attaching said platform to a lower end of said boom assembly in alignment with said rungs or to an upper end of said boom assembly for horizontal alignment with said primary platform when said primary load carrier means is moved to the upper end of said boom assembly.

9. The portable conveyor system of claim 8 further comprising pedestal means mounted on said unloading platform for adjusting the horizontal alignment of said unloading platform with said primary platform.

10. The portable conveyor system of claim 8 further comprising an overhead bracket assembly sized for attachment over a sill of a window frame to receive said unloading platform thereon and means for releasably clamping said bracket assembly over said sill.

11. The portable conveyor system of claim 10 further comprising means for releasably attaching an upper end of said boom assembly to said bracket assembly.

12. The conveyor system of claim 1 wherein said first adjustment means comprises socket means for receiving a head of an impact wrench therein and means interconnected between said socket means and said primary platform for selectively pivoting said platform in response to rotation of said socket means.

13. The conveyor system of claim 1 wherein said second adjustment means comprises socket means for receiving a head of an impact wrench therein and drive means interconnected between said socket means and said hitch for selectively moving said hitch in response to rotation of said socket means.

14. The conveyor system of claim 1 wherein said primary load carrier means further comprises an undercarriage having a pair of laterally spaced endless track assemblies and spring means mounted between said frame and said undercarriage for providing a resilient suspension system therebetween.

15. The conveyor system of claim 1 further comprising guide means secured on at least some of said supporting surfaces for guiding linear travel of said primary load carrier means on said boom assembly and for preventing lateral shifting of said primary load carrier means on said boom assembly.

16. In a portable conveyor system having an extensible and retractable telescopic boom assembly mounted on a stationary support, a plurality of longitudinally spaced rungs secured on said boom assembly to define a series of co-planar supporting surfaces, and a mobile primary load carrier mounted for movement along the supporting surfaces of said rungs, said primary load carrier comprising a frame, a load-carrying primary platform pivotally mounted on a forward end of said frame, first adjustment means for selectively pivoting said primary platform to an inclined position relative to said frame, a hitch adapted for attachment to a cable, means for mounting said hitch on the forward end of said frame for vertical reciprocal movement thereon, and second adjustment means for selectively moving said hitch vertically relative to said frame to control the disposition of said primary load carrier on the supporting surfaces of said rungs when said cable is attached thereto.

17. The conveyor system of claim 16 wherein said first adjustment means comprises socket means for receiving a head of an impact wrench therein and means interconnected between said socket means and said primary platform for selectively pivoting said platform in response to rotation of said socket means.

18. The conveyor system of claim 16 wherein said second adjustment means comprises socket means for receiving a head of an impact wrench therein and drive means interconnected between said socket means and said hitch for selectively moving said hitch in response to rotation of said socket means.

19. The conveyor system of claim 16 wherein said primary load carrier further comprises an undercarriage having a pair of laterally spaced endless track assemblies and spring means mounted between said frame and said undercarriage for providing a resilient suspension system therebetween.

* * * * *

UNITED STATES PATENT AND TRADEMARK OFFICE

CERTIFICATE OF CORRECTION

PATENT NO. : 4,875,547

DATED : October 24, 1989

INVENTOR(S) : Philip T. Hanthorn

It is certified that error appears in the above-identified patent and that said Letters Patent is hereby corrected as shown below:

IN THE SPECIFICATION:

Column 3, line 14, change "2" to --26--.

Column 3, line 38, change "ink" to --link--.

Column 4, line 27, change "5" to --58--.

Column 4, line 31, change "lad" to --load--.

Column 5, lines 23, 31 and 36, change "66" to --87--.

Signed and Sealed this

Fifteenth Day of January, 1991

*Attest:*

HARRY F. MANBECK, JR.

*Attesting Officer*

*Commissioner of Patents and Trademarks*